US010995585B2

(12) United States Patent
Roessler et al.

(10) Patent No.: US 10,995,585 B2
(45) Date of Patent: May 4, 2021

(54) ELECTRONIC VALVE WITH DEFORMABLE SEAT AND METHOD

(71) Applicant: GEODYNAMICS, INC., Millsap, TX (US)

(72) Inventors: Dennis Roessler, Ft. Worth, TX (US); Raymond Shaffer, Burleson, TX (US)

(73) Assignee: GEODYNAMICS, INC., Millsap, TX (US)

( * ) Notice: Subject to any disclaimer, the term of this patent is extended or adjusted under 35 U.S.C. 154(b) by 84 days.

(21) Appl. No.: 16/286,745

(22) Filed: Feb. 27, 2019

(65) Prior Publication Data

US 2020/0165900 A1 May 28, 2020

Related U.S. Application Data

(60) Provisional application No. 62/771,390, filed on Nov. 26, 2018.

(51) Int. Cl.

| | |
|---|---|
| ***E21B 34/06*** | (2006.01) |
| ***E21B 34/14*** | (2006.01) |
| ***E21B 43/26*** | (2006.01) |
| ***E21B 34/10*** | (2006.01) |
| ***E21B 47/00*** | (2012.01) |
| *E21B 47/06* | (2012.01) |

(52) U.S. Cl.

CPC ..... *E21B 34/066* (2013.01); *E21B 34/10* (2013.01); *E21B 34/14* (2013.01); *E21B 34/142* (2020.05); *E21B 47/00* (2013.01); *E21B 43/26* (2013.01); *E21B 47/06* (2013.01); *E21B 2200/06* (2020.05)

(58) Field of Classification Search

CPC ..... E21B 34/066; E21B 34/10; E21B 34/14; E21B 34/142; E21B 43/26; E21B 2200/06

See application file for complete search history.

(56) References Cited

U.S. PATENT DOCUMENTS

| | | | | |
|---|---|---|---|---|
| 3,054,415 | A | 9/1962 | Baker et al. | |
| 9,752,409 | B2 * | 9/2017 | Graf | E21B 34/14 |
| 10,053,958 | B2 * | 8/2018 | Purkis | E21B 23/06 |
| 10,060,243 | B2 * | 8/2018 | Graf | E21B 23/004 |
| 10,066,467 | B2 * | 9/2018 | Getzlaf | E21B 34/103 |

(Continued)

FOREIGN PATENT DOCUMENTS

WO 2018076119 A1 5/2018

OTHER PUBLICATIONS

International Search Report and Written Opinion of the International Searching Authority (Forms PCT/ISA/220, PCT/ISA/210 and PCT/ISA/237) for International Application No. PCT/US 19/19708, dated May 7, 2019.

*Primary Examiner* — Jennifer H Gay

(74) *Attorney, Agent, or Firm* — Patent Portfolio Builders PLLC

(57) ABSTRACT

An electronic valve is placed in line with a casing in a well. The electronic valve includes a housing having plural ports that are blocked; a valve configured to initiate unblocking of the plural ports to allow fluid communication between the bore of the housing and an outside of the housing; and a deformable seat device having a body placed inside of the bore of the housing. The deformable seat device is configured to have a given diameter D3 for at least one of first and second ends of the body when the plural ports are blocked, and a smaller diameter when the plural ports are unblocked.

25 Claims, 16 Drawing Sheets

(56) References Cited

U.S. PATENT DOCUMENTS

| | | | | |
|---|---|---|---|---|
| 2004/0163820 | A1 | 8/2004 | Bishop et al. | |
| 2013/0118732 | A1* | 5/2013 | Chauffe | E21B 34/14 166/250.04 |
| 2014/0246207 | A1* | 9/2014 | Hofman | E21B 43/26 166/373 |
| 2015/0068757 | A1* | 3/2015 | Hofman | E21B 34/063 166/318 |
| 2017/0058642 | A1* | 3/2017 | Roessler | E21B 43/14 |
| 2017/0058643 | A1 | 3/2017 | Snider et al. | |
| 2017/0211351 | A1* | 7/2017 | Graf | E21B 34/063 |
| 2018/0340396 | A1 | 11/2018 | Cox et al. | |
| 2020/0165900 | A1* | 5/2020 | Roessler | E21B 34/066 |

* cited by examiner

Section A-A

ELECTRONIC VALVE WITH DEFORMABLE SEAT AND METHOD

BACKGROUND

Technical Field

Embodiments of the subject matter disclosed herein generally relate to well operations associated with oil and gas exploration, and more specifically, to techniques and processes for fracturing a well with an electronic valve that has a deformable seat.

Discussion of the Background

After a well is drilled into an oil and gas reservoir, a casing is installed in the well. The casing needs to be connected to the oil from the reservoir so that the oil can be brought to the surface. As illustrated in FIG. 1, a well exploration system 100 has a gun string 102 that is lowered into the casing 104 with a wireline 106 or equivalent tool. The gun string may be attached to a setting tool 110 that is used to set a plug 112, to close the casing 104 at a desired location. Then, the shaped charges 114A and 114B of the gun string 102 are fired to make holes into the casing, to connect a formation 120 of the oil and gas reservoir with the inside of the casing 104. At this time, the oil and gas from the formation are free to flow into the casing.

As the time passes and more oil and gas is extracted from the reservoir, the pressure of the oil decreases, so that the oil cannot reach the head 122 of the well 104 under its own pressure. When this happens, a fluid is pumped with pump 130 into the casing to open up the channels 126A and 126B formed by the shaped charges 114A and 114B, respectively, into the formation 120.

However, a problem with the existing horizontal wells, is that the length of the well is large, and thus, the friction between the gun string and the interior of the casing, when deploying the gun string, is large, which makes sometimes difficult if not impossible the operation of placing the gun string at the toe of the horizontal well. Even if the gun string can be deployed all the way to the toe of the horizontal well, the amount of time and resources (e.g., sources) needed for this operation are considerable, which slows down the entire oil extraction process and makes more expensive the recovered oil and gas.

Thus, in an effort to solve this problem, it is possible to use a valve 200 that is integrated into the casing 104, as shown in FIG. 2. Essentially, such a valve 200 has an outer port 202, which communicates with the formation 120, and an inner port 204, which communicates with the bore 105 of the casing 104. A moving piston or sleeve 206 is placed between the two ports 202 and 204 to prevent fluid communication. The sleeve 206 may have its own port 208, which is initially misaligned with the two ports 202 and 204. When it is necessary to connect the formation 120 to the bore 105 of the casing 104, the sleeve 206 is moved to align the three ports 202, 204, and 208, or the sleeve moves out between the ports 202 and 204 so that fluid communication is achieved between the formation 120 and the bore 105 of the casing 104. However, the existing valves require sophisticated mechanisms for opening and closing the ports, and especially, it is not possible to use a cluster of such valves so that different valves from the cluster are opened at different times, which would result in different formations being fractured at different times.

Thus, there is a need for a valve that overcomes the above noted problems, is suitable for fracturing long, horizontal casings, can be used in a cluster with other similar valves to open at different times, and can also provide a mechanism for isolating the valve, after it was opened and its associated formation was fractured.

SUMMARY

According to an embodiment, there is an electronic valve to be placed in line with a casing in a well. The electronic valve includes a housing having plural ports that are blocked; a valve configured to initiate unblocking of the plural ports to allow fluid communication between the bore of the housing and an outside of the housing; and a deformable seat device having a body placed inside of the bore of the housing. The deformable seat device is configured to have a given diameter D3 for at least one of first and second ends of the body when the plural ports are blocked, and a smaller diameter when the plural ports are unblocked.

According to another embodiment, there is a well fracturing system for fracturing a well, and the system includes a casing having plural tubular modules and one or more electronic valves integrated with the plural tubular modules. An electronic valve of the one or more electronic valves has a sleeve that blocks plural ports and a deformable seat device that changes a diameter of at least one of first and second ends when actuated by a piston.

According to still another embodiment, there is a method for fracturing a well with an electronic valve, the method including attaching the electronic valve to a casing of the well; pumping a fluid through a bore of the electronic valve to fracture a formation associated with another electronic valve; releasing a ball into the casing to block the another electronic valve; detecting the ball as it passes through the electronic valve; opening plural ports of the electronic valve to fracture a formation associated with the electronic valve; and changing a geometry a deformable seat device of the electronic valve.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to an electronic valve with a deformable seat device that is dispatched at a toe of a well for achieving fluid connection between the bore of the casing and the outside formation. However, the embodiments discussed herein are not limited to using the electronic valve with the deformable seat device only inside the well, but this valve may also be used in other environments where a fluid connection needs to be established between the inside and outside of an enclosure.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, an electronic valve with a deformable seat device (simply called herein the electronic valve) is configured to be electronically actuated for fluidly connecting a bore of the electronic valve to an underground formation outside the electronic valve. The term "deformable" is understood to mean that an element can be plastically or elastically bend to change its geometry and/or an element can be made of plural parts that can be moved relative to each other so that the element changes its geometry although no physical part of the element is deformed. The electronic valve also includes a seat device for receiving and seating a first blocking device (for example, a ball) at a first end, and a second blocking device at a second end, which is opposite to the first end. The seat device is deformable so that initially there is no seating, but after the electronic valve is actuated, a geometry of the seat device is altered (for example, the seat device is bent) so that first and second seats are formed. The electronic valve is configured to be integrated into the casing so that after the casing is installed in the well, the electronic valve is cemented in place together with the casing. The electronic valve may be used with other electronic valves, in a cluster, also integrated into the casing, so that in conjunction with the first and second blocking devices, a stage can be insulated from a next stage. The electronic valve is now discussed in more detail with regard to the figures.

Figure 1:
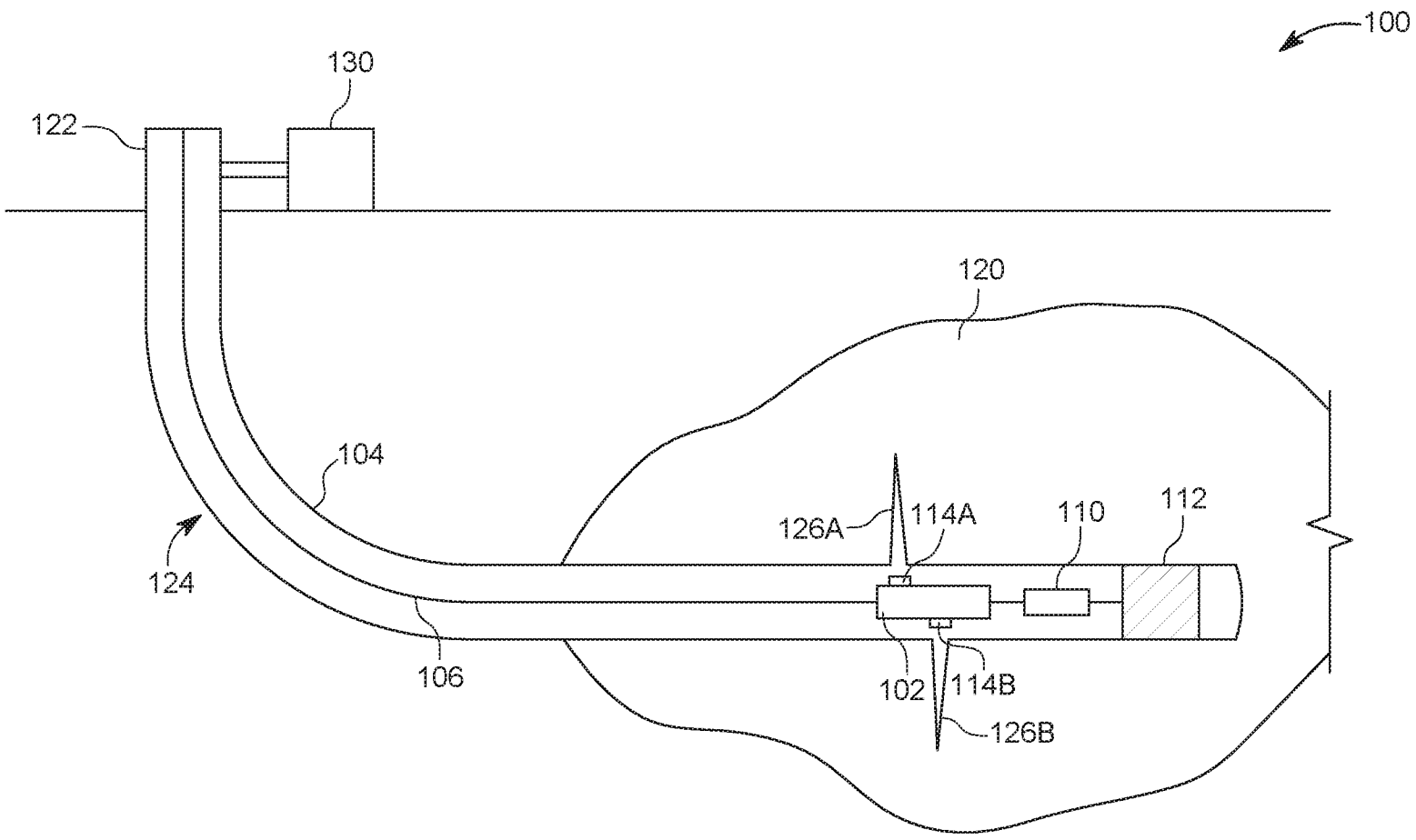
FIG. 1 illustrates a gun based system for fracturing a well.
Figure 2:
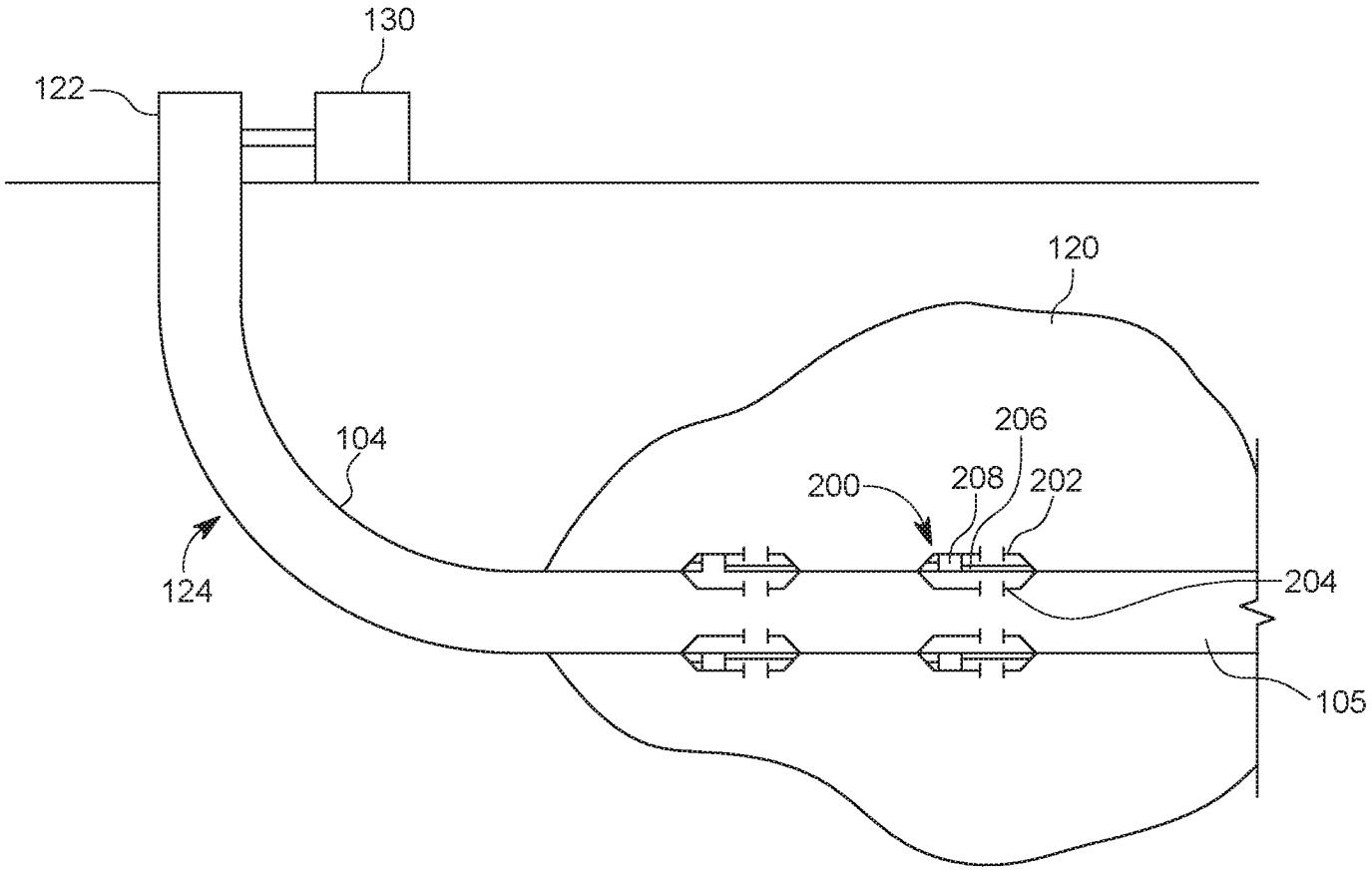
FIG. 2 illustrates a valve based system for fracturing a well.
Figure 3:
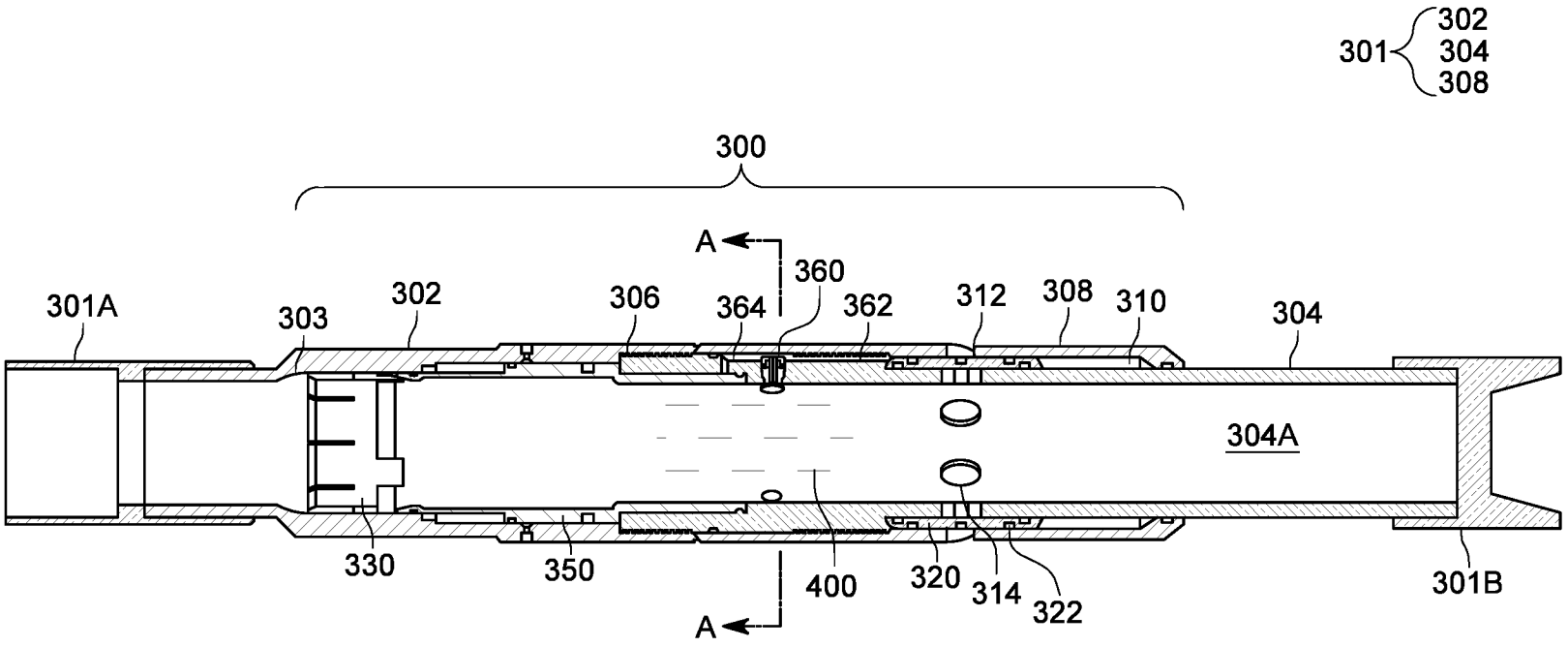
FIG. 3 shows an electronic valve that is configured to open ports at one end and deform a seat device at another end.

FIG. 3 shows an overview of the electronic valve 300, which includes an upper body 302 that is attached to an inner mandrel 304. These two elements may be connected to each other by using threads 306. However, the two elements may also be attached to each other in other ways. An external cover 308 is located over the inner mandrel 304 for form a chamber 310. The upper body 302, inner mandrel 304, and external cover 308 form the housing 301. In one application, the housing 301 also includes an upper connection 301A and a lower connection 301B that directly attach to corresponding parts of the casing (not shown). Chamber 310 has one or more ports 312 formed in the external cover 308. Plural corresponding ports 314 are formed into the inner mandrel 304. A sliding sleeve 320 is placed inside chamber 310, to prevent fluid communication between the ports 312 in the external cover 308 and corresponding ports 314 in the inner mandrel 304 when in a closed position. If sleeve 320 is moved to the other end of the chamber 310 for the open position, then fluid communication is achieved between ports 312 and ports 314, so that a fluid from outside the valve 300 can enter inside the bore 304A of the inner mandrel 304. One or more o-rings 322 may be placed on the sleeve 320, to face the external cover 308 and/or the inner mandrel 304, to prevent a fluid from outside or inside the valve to leak along the sleeve 310.

Figure 4A:
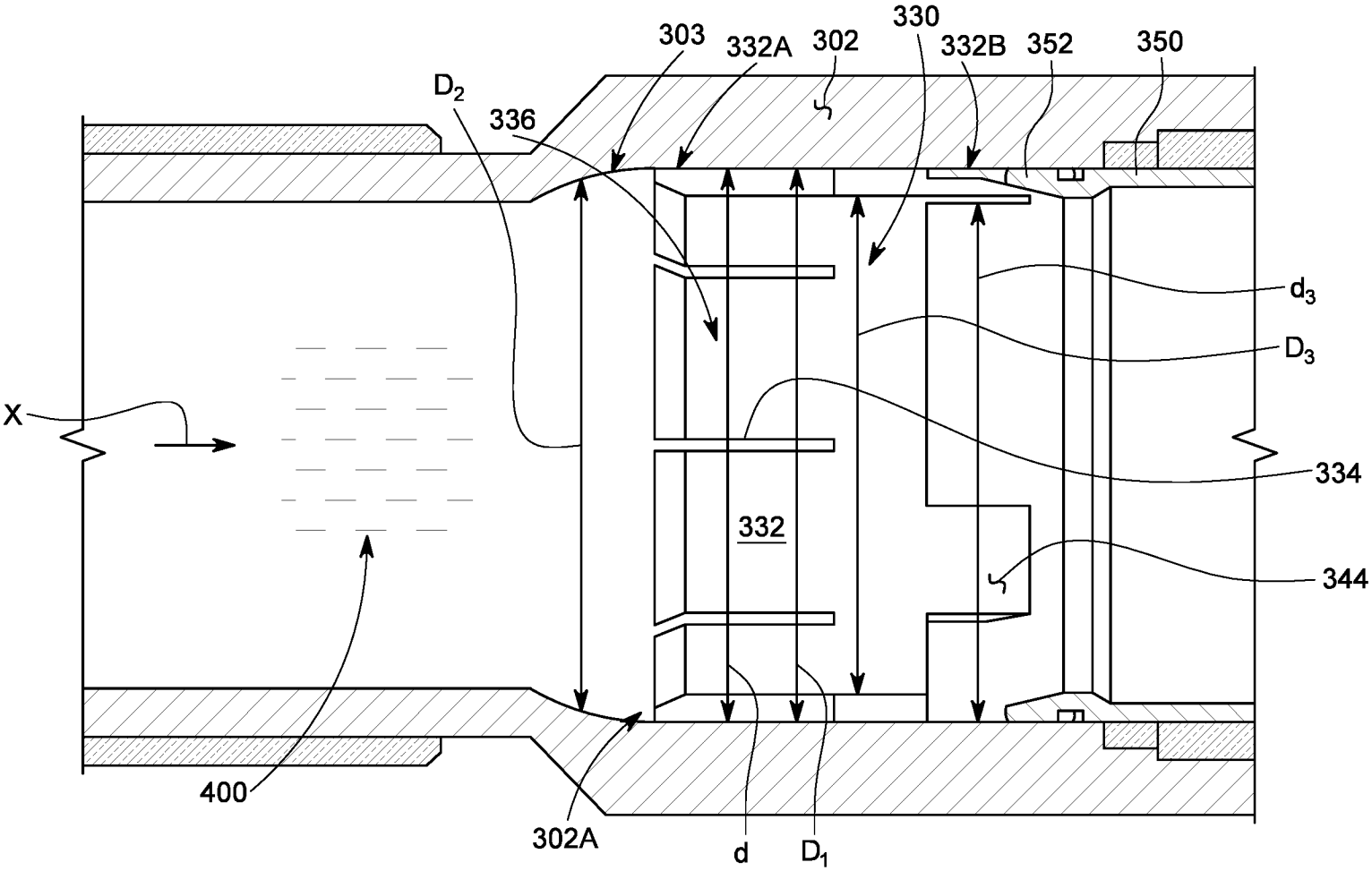
FIGS. 4A and 4B show details of a deformable seating device that is part of the electronic valve.

At the other end of the valve 300, in the upper body 302, there is provided a deformable seat device 330. The deformable seat device 330 is made of a material, e.g., aluminum, that is malleable and can be bent when under the influence of a bending force. In one application, the material from which the deformable seat device is made retains the deformation even after the bending force is removed. The deformable seat device 330 is shown in more detail in FIG. 4A, as having a body 332 that is cylindrical and configured to tightly fit inside the bore 302A of the upper body 302. Further, FIG. 4A shows that the body 332 has various slots 334, extending along a longitudinal axis X, which define finger regions 336. Because of these slots, as discussed later, the finger regions 336 could bend one relative to another and form a seat, which would have an exterior diameter smaller than the current exterior diameter d of the deformable seat device 330. In this regard, note that in the undeformed position shown in FIG. 4A, the external diameter d of the body 332 matches the diameter D1 of the bore 302A of the upper body 302.

Figure 4B:
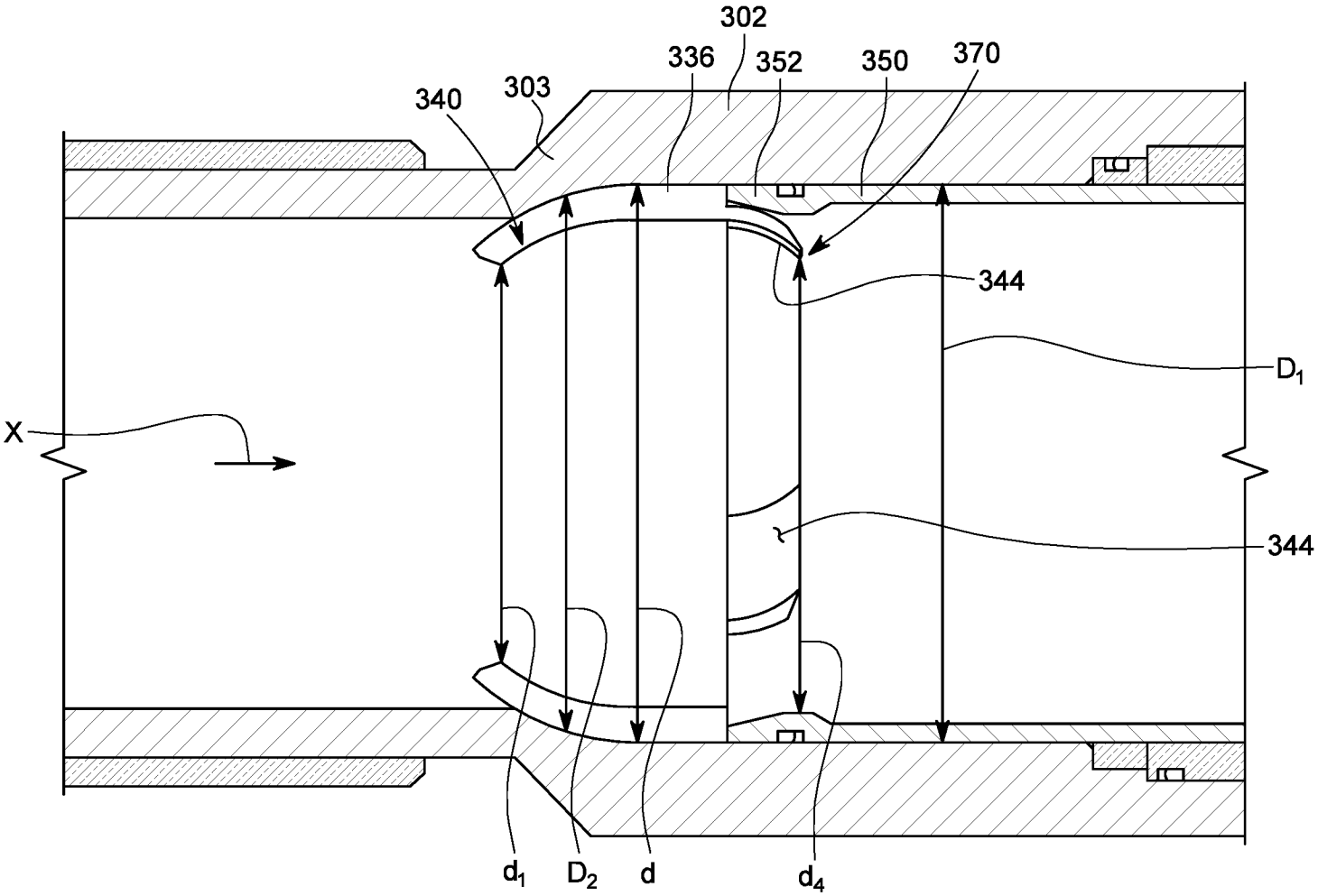

However, FIG. 4A also shows that the inner bore 302A of the upper body 302 has a curved portion 303, having an inner diameter D2 smaller than the diameter D1 of the bore 302A of body 302. The curved portion 303 is used to bend the upper end 332A of the body 332 of the deformable seat device 330, to form a first seat 340, as illustrated in FIG. 4B. This happens when the body 332 moves in an upward direction, as discussed later, and finger regions 336 move along the negative direction of the longitudinal axis X, and because of the curved portion 303, they are bent toward the interior of the body 332. Note that the first seat 340 has an internal diameter dl which is smaller than a diameter D3 of a bore of the body 332.

Returning to FIG. 4A, the body 332 has plural tabs 344 at the lower end 332B of the body. Note that in this patent, the terms "upper" and "lower" refer to a direction of a well, where the term "upper" indicates an end of an element that is closest to a head of the well and the term "lower" indicates an end of the element that is closest to a toe of the well. The tabs 344 are initially distributed on a circle having a diameter D3, which is the diameter of the bore of the body 332. These tabs 344 are configured to be bent by a wedge shape portion 352 of an internal piston 350 of the valve 300. In this regard, note that FIG. 3 shows the internal piston 350 being mainly located inside the upper body 302. The elements discussed above (i.e., inner mandrel, deformable seat device, and internal piston) are manufactured to have the same internal diameter to form the smooth bore 304A shown in FIG. 3. However, in one embodiment, it is possible to have these elements made to have different internal diameters.

Returning to FIG. 4A, it is noted that both the body 332 of the deformable seat device 330 and the piston 350 are hollow structure that allow a fluid 400 to pass through their bores, toward a next electronic valve. In fact, in one embodiment, the bores of the body 332 and the piston 350 are as large as the bore 304A of the inner mandrel 304.

FIG. 3 further shows a valve 360 formed in the wall of the inner mandrel 304. When the valve 360 is opened (to be discussed later), the fluid 400 under pressure from the bore 304A passes through the valve 360 and enters into a first passage 362, which extends at an interface between the inner mandrel 304 and the external cover 308. The first passage 362 is in fluid communication with the sleeve 312. The fluid 400 under pressure also enters a second passage 364, which extends at an interface between the inner mandrel 304 and the interior of the external cover 308. The second passage 364 communicates with an end of the piston 350.

Thus, when the high pressure fluid 400 from the bore 304A enters the first passage 362, the sleeve 312 is displaced to the opposite end of the chamber 310, so that the ports 312 and 314 are in direct fluid communication. At the same time, the high-pressure fluid 400 also enters the second passage 364, which activates piston 350, and the wedge shaped portion 352 of the piston engages a corresponding tab 344, as shown in FIG. 4A, and bends the tab 344 as shown in FIG. 4B, forming a second seat 370, which has an internal diameter d4 smaller than the diameter D3 of the circle on which the tabs 344 are initially distributed (see FIG. 4A). In this way, by opening the valve 360, the ports 312 and 314 are made to fluidly communicate, and the first and second seats 340 and 370 are formed. In other words, the deformable seat device 330 is configured to have a given diameter D3 at first and second ends 332A, 332B of the body 332 when the plural ports 314 are blocked by sleeve 320, and different diameters (smaller) when the plural ports 314 are unblocked.

Figure 5:
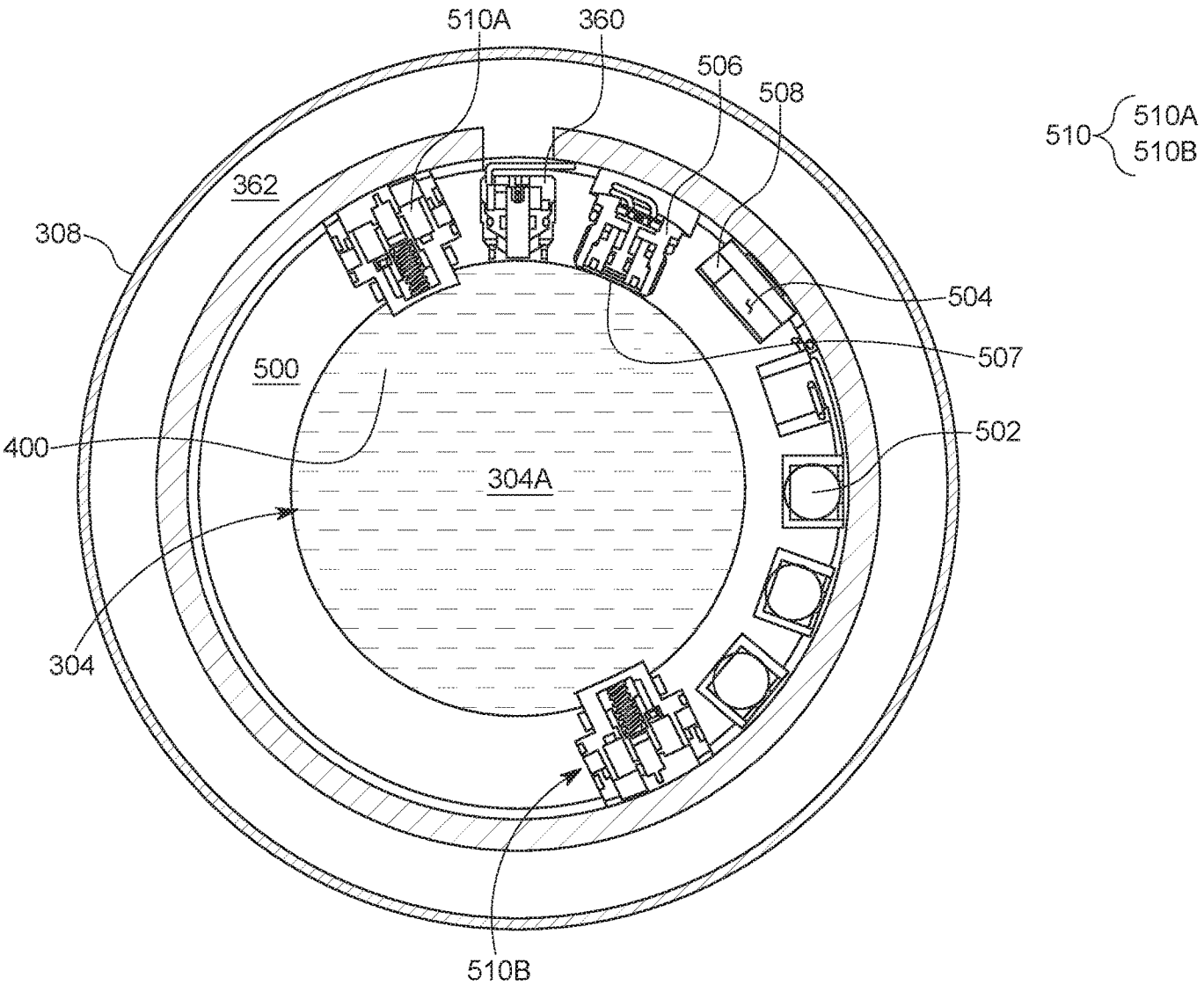
FIG. 5 shows electronics located inside the electronic valve.

A section A-A through the electronic valve 300 and the valve 360 is shown in FIG. 5. In this figure, it is shown that various electronic modules are placed in an empty pocket 500 formed in the body of the inner mandrel 304. Some of the electronic modules include a power source 502 (for example, a dry cell), a microprocessor 504, a start switch assembly 506, a dump valve 360, and a ball detection switch 510. In this embodiment, the ball detection switch 510 has two parts 510A and 510B, located diametrically opposed in the pocket 500. Each part has a piston that physically protrudes inside bore 304A. The microprocessor 504 is either programmed in software or hardwired to have a timer 508, which is programmed for the first valve (the one closest to the toe of the well) to have a given value, for example, 30 minutes. Other values are possible. For the rest of the electronic valves located in the well, their timers are disabled or not present.

The start switch assembly 506 has a burst disk 507 that is directly exposed to the pressure of the fluid 400 present in the bore 304A. The start switch assembly 506 is configured to activate the electronics inside the pocket 500, by providing power from the power source 502 to the other components. Note that this switch prevents draining the power source before the electronics is really necessary to be used to open the dump valve 360. Disk 507 can be broken by the fluid inside the bore 304A when its pressure is increased over the rated breaking pressure of the disk.

Figure 6:
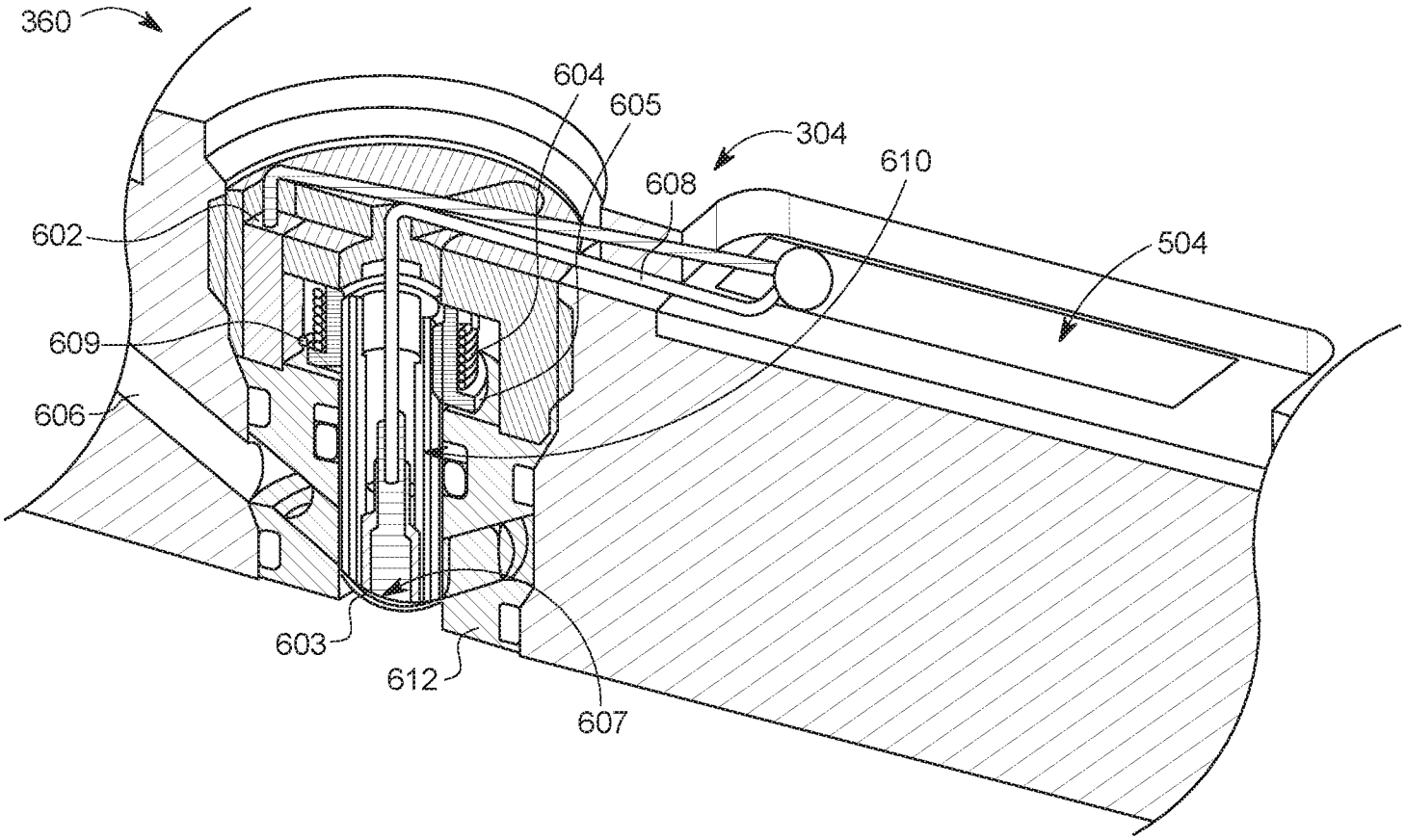
FIG. 6 shows a dump valve of the electronic valve.

The valve 360 may be implemented in various ways. For example, FIG. 6 shows one possible configuration of the valve, that includes a fusible link 602 electrically connected to the electronic circuit 504, a split spool device 605, and a spring 604 surrounding the spool. The electrical connection of the fusible link to the electronic circuit is not shown. The split spool device 605 has a center pin assembly 610 held in place in a restrained position by the spool, and the spring 604 surrounding the spool. The timer in the electronic circuit 504 may be actuated by a pressure switch or the ball detection switch 510. After elapse of a predetermined time delay, set in the timer by the operator before lowering the tool downhole, the timer generates a signal to initiate burning of the fusible link 602. The fusible link, which is mechanically restraining the spring 604, ruptures, thereby breaking the restraining connection 609 between the fusible link 602 and the spring 604. As a result, the center pin 610 travels upwards along with plunger 607 causing the rupture disk membrane 603 of rupture disk 612 to deflect upward and burst thereby opening the port 606 of the sliding valve to permit fluid flow. Of course, in another embodiment, the bursting of the rupture disk can be used to activate an entirely different activity in a downhole tool. In one application, the dump valve 360 may be implemented as a solenoid control valve or other types of known electronic valves.

The ball detection switch 510 is electronically connected to processor 504 and provides information to the processor each time a ball passes by. A ball counter (implemented in software at the processor or hardwired) is configured with a value in incremental order for each electronic valve in the cluster, i.e., having a value 0 for the most distal electronic valve from the head of the well, a value 1 for the next electronic valve, and so on.

Figure 7:
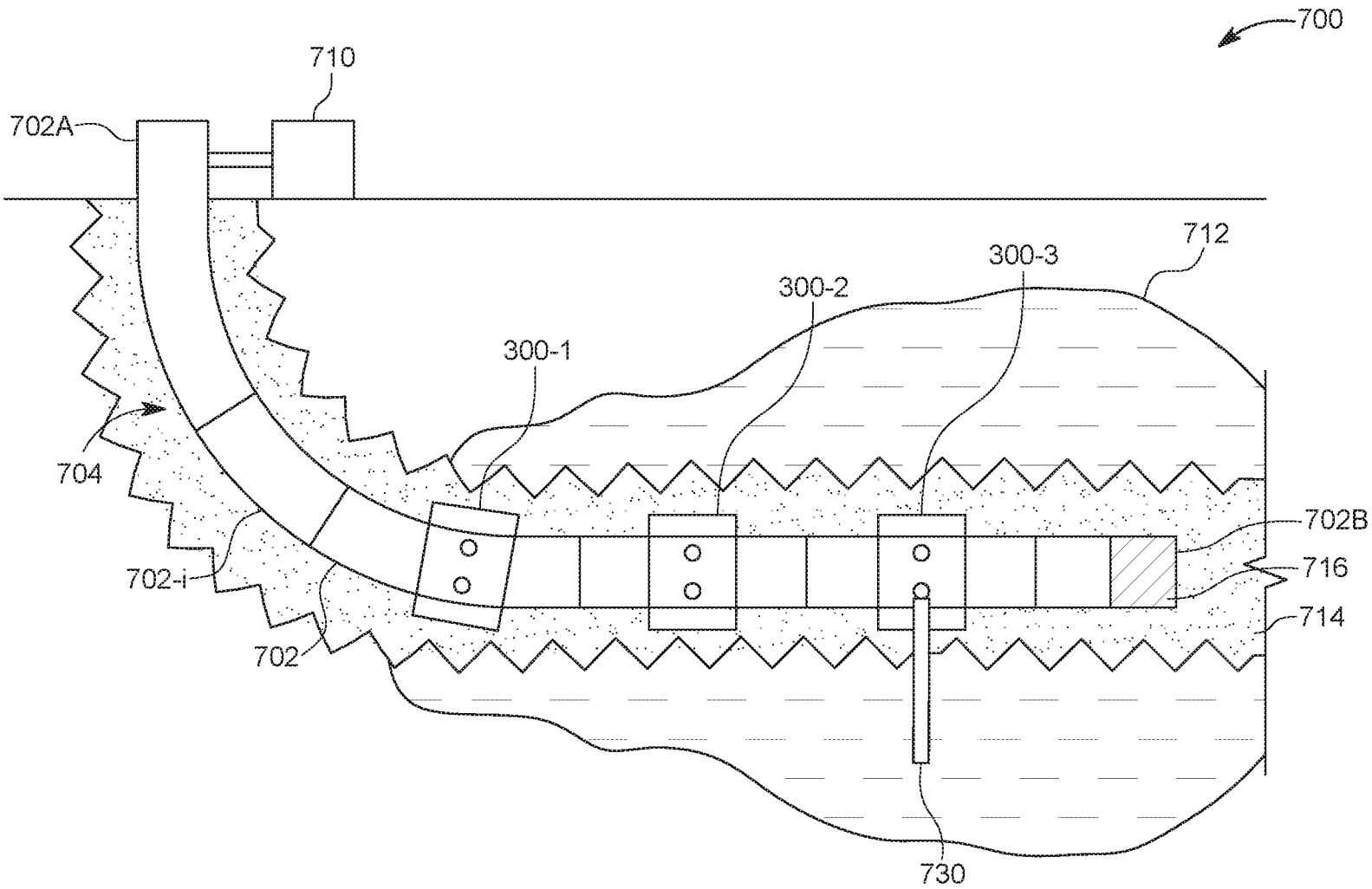
FIG. 7 shows a cluster of electronic valves having deformable seating devices.

A method for fracturing a well with a cluster of electronic valves 300 is now discussed. FIG. 7 shows a well fracturing system 700 that includes plural electronic valves 300-1 to 300-3 (only three shown for simplicity, but the system can have any number of valves, between 1 and tens if not hundreds of them) distributed along casing 702. This means that the casing 702 includes plural modules **702-*i* (only one labeled in FIG. 7) connected to each other or to one or two electronic valves. Note that valve 300 is configured with threads or equivalent mechanisms to be directly attached to one or two modules 702-*j* of the casing 702. The casing is located inside well 704, and has a head 702A and a toe 702B. The head 702A may be connected to a pump 710 for fracturing the underground formation 712**.

Figure 8:
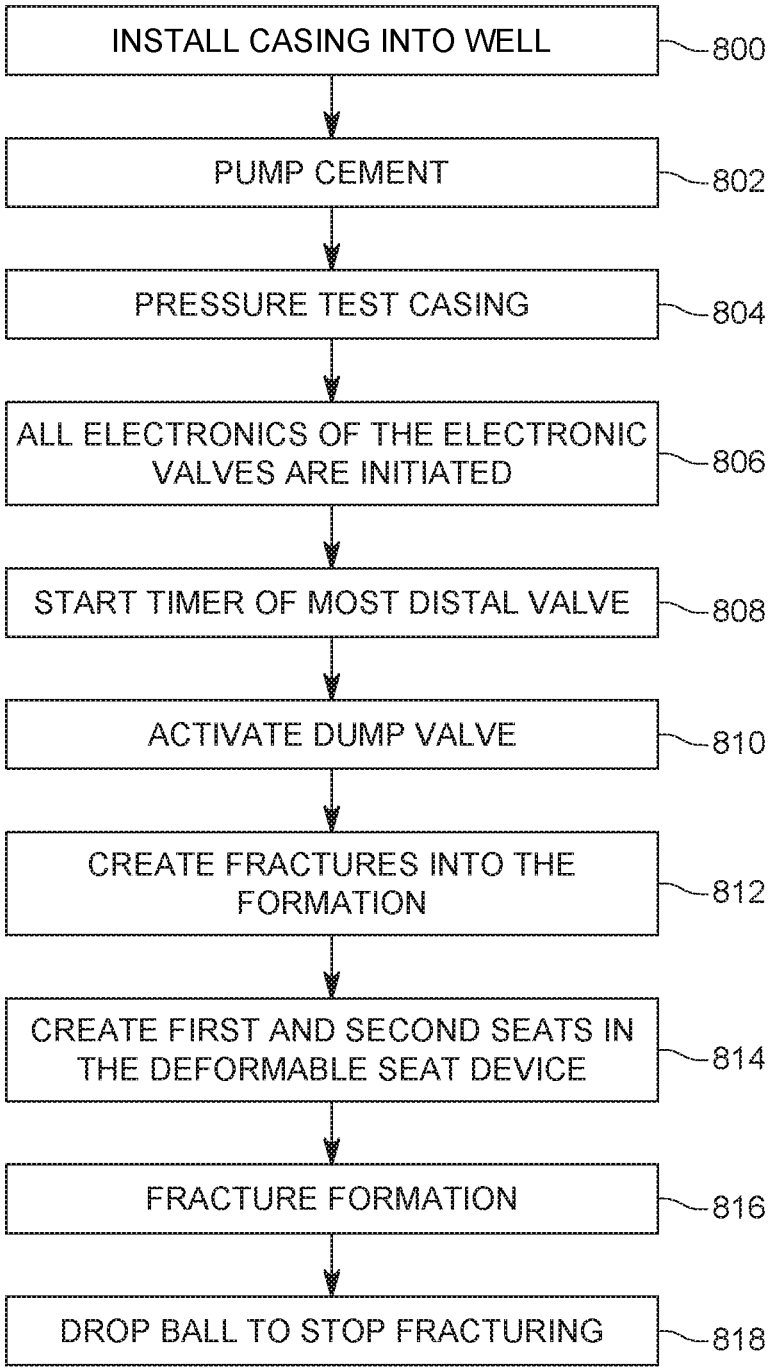
FIG. 8 is a flowchart of a method of fracturing a well with the cluster of electronic valves.

According to the method for operating these electronic valves, which is illustrated in FIG. 8, in step 800 the casing together with the electronic valves are lowered into the well. In step 802, cement 714 is pumped through a toe valve 716 of the casing, to fill the space between the casing and the bore of the well. Before the cement hardens, a wiper plug is run through the casing to remove any residual cement, in step 804, the casing is pressure tested with a threshold pressure (for example, 10,000 psi). This pressure is larger than the breaking pressure (e.g., 9,000 psi) of the burst disks 507 of the start switch assembly 506. Thus, in step 806, all the burst disks 507 of all the start switch assemblies 506 of all electronic valves 300-1 to 300-3 are ruptured and their associated processors and electronics are activated, i.e., power is supplied to these electronic components from the power source 502 of each electronic valve.

In step 808, the timer 508 of the most distal electronic valve 300-3 is starting its count-down. The count-down time of the timer of this electronic valve has been previously set by the operator of the electronic valve. Note that the other electronic valves either do not have a timer or the timers have been disabled. In step 810, the dump valve 360 of the most distal electronic valve 300-3 is actuated, by the processor, when the processer determines that the count-down time of the timer has elapsed. The fluid under pressure that is present in the bore 304A of the casing 304 enters through the valve 300-3, and advances along the first and second passages 362 and 364. The fluid that enters the first passage 362 moves the sleeve 320 inside chamber 310, until the fluid passage between ports 312 and 314 is opened up (see FIG. 9) and the high pressure fluid from the casing 304 enters into the formation 712, to make fractures 730 in step 812. In step 814, the fluid that entered the second passage 364, pushes the piston 350 toward the head of the casing (away from the toe of the casing) so that the deformable seat device 330 has its body 332 deformed at the two opposite ends, to create the first seat 340 and the second seat 370 (see FIG. 9). Note that the first and second seats have an internal diameter smaller than an internal diameter of the inner mandrel 304. Also note that piston 350 has a shoulder 354 on which the pressure of the fluid 400 from the casing 304 acts in order to move the piston in an upward direction, opposite to the longitudinal axis X.

Figure 9:
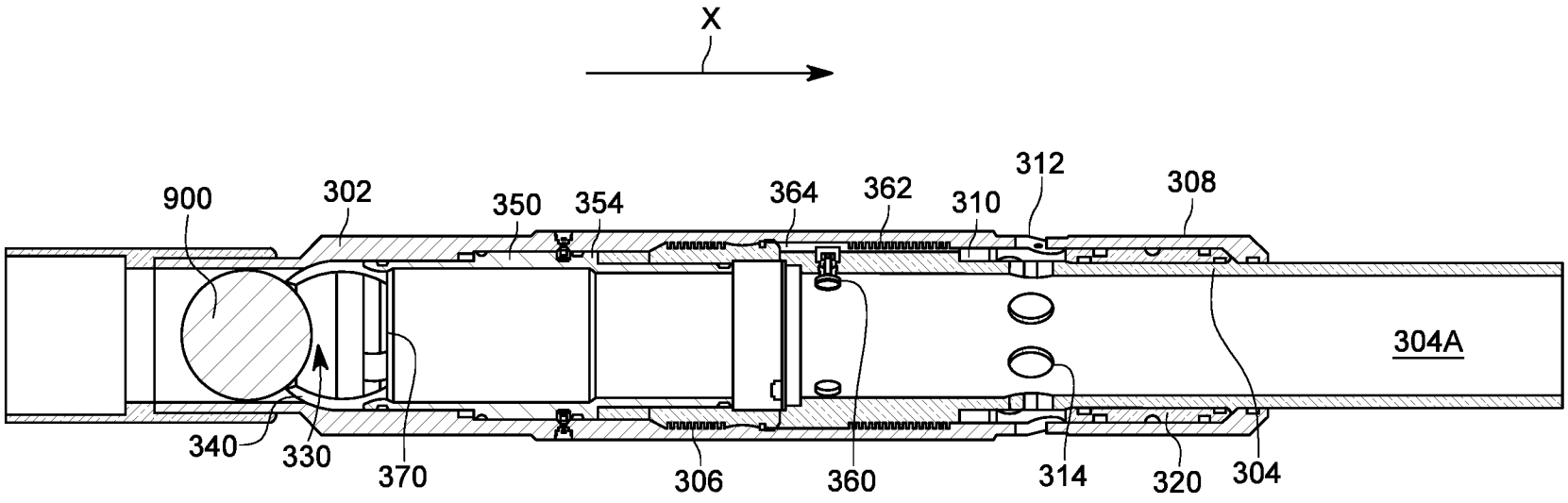
FIG. 9 illustrates the electronic valve with the ports opened and the deformable seating device forming first and second seats.

Now that the electronic valve 300-3 has been opened, the pump 710 (see FIG. 7) is used in step 816 to pump a slurry through open electronic valve to form the fractures 730. At the end of the fracturing step, a first blocking device 900 (for simplicity, a ball) is dropped in step 818 into the well, from the head of the casing. When the ball 900 arrives at the upper end of the electronic valve 300-3, as illustrated in FIG. 9, the ball seats at the first seat 340 and blocks the flow of fluid through the electronic valve 300-3. Thus, the fracturing of the stage associated with the most distal electronic valve 300-3 in FIG. 7 is stopped and this stage is also insulated from the next one.

Figure 10:
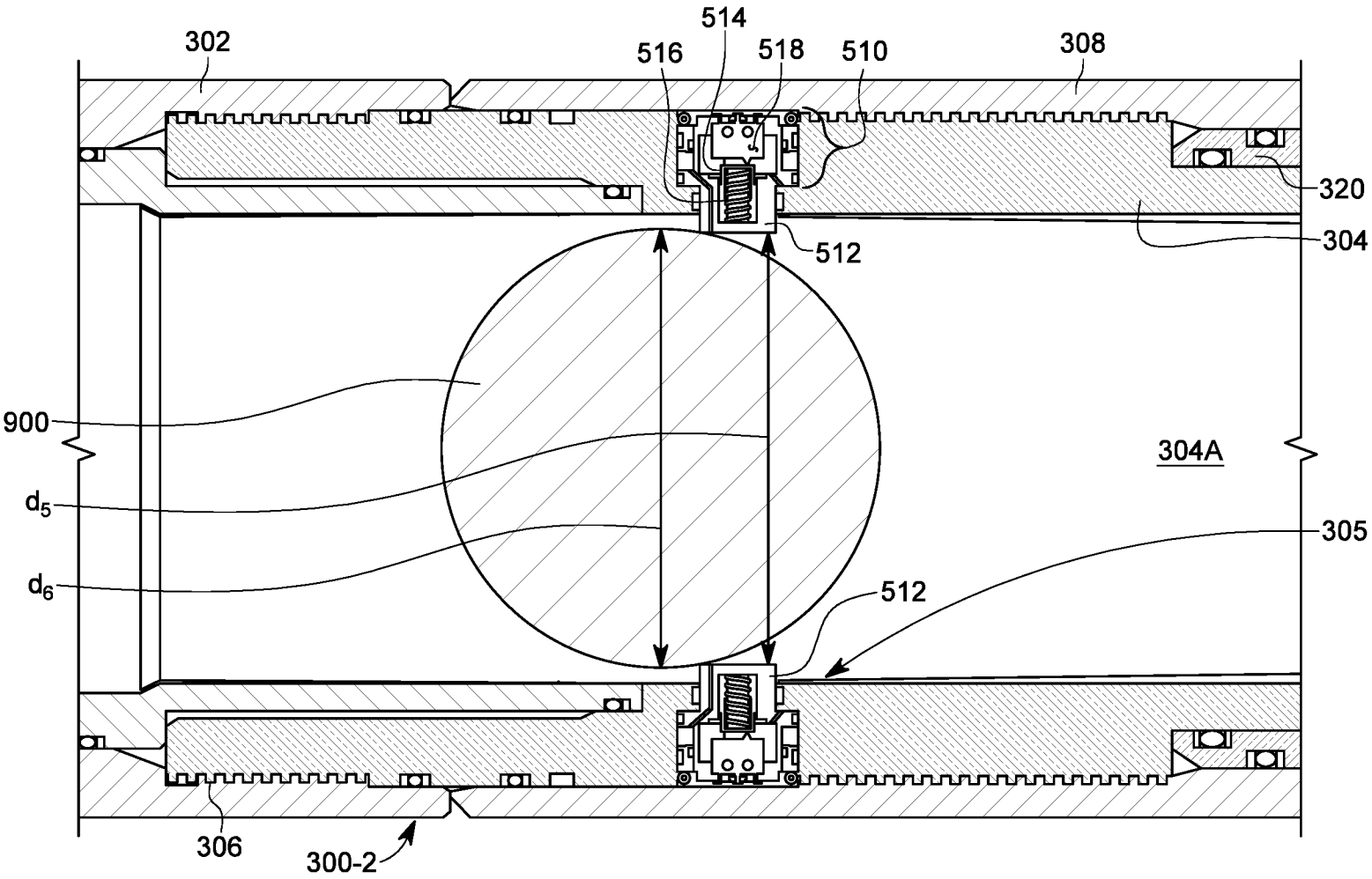
FIG. 10 illustrates a ball that is passing through a bore of the electronic valve.

Before reaching the first seat 340 of the electronic valve 300-3, the ball 900 passes through the other electronic valves, 300-1 and 300-2 in the embodiment of FIG. 7. While passing any of these electronic valves, as illustrated in FIG. 10 for valve 300-2, the ball 900 interacts with the ball detection switch 510 of this valve. FIG. 10 shows that the ball detection switch 510, although positioned in the inner mandrel 304, has a switch piston 512, which protrudes from an internal surface 305 of the inner mandrel 304, into the bore 304A. In other words, an internal diameter d5 of the ball detection switch 510, measured between two opposite switch pistons 512, is smaller than an external diameter d6 of the ball 900.

Figure 11:
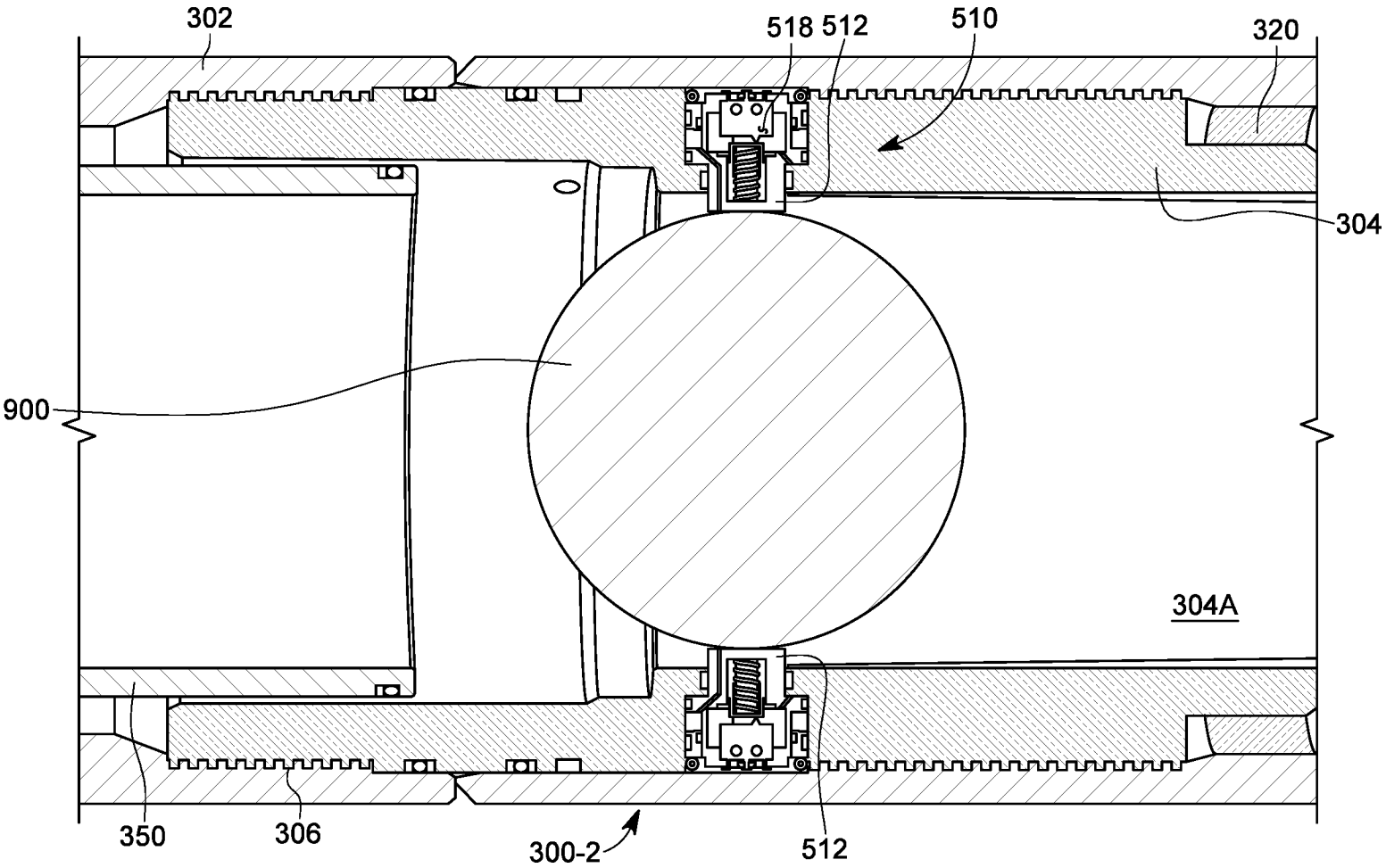
FIG. 11 illustrates the ball interacting with a ball counting device located in the electronic valve.

Further, the switch pistons 512 can be pushed inside the ball detection switch 510, for example, by the ball 900, when the ball 900 passes along the bore 304A. The switch pistons 512 are in mechanical contact with corresponding inner pistons 514, which are configured to be located inside the ball detection switch 510, and to have a limited travel path. A biasing device 516 (for example a spring) is providing a separating force between the switch piston 512 and the inner piston 514 and keeps the two pistons under a permanent tension, so that when the switch piston 512 is pressed by the ball 900, the inner piston 514 moves towards an electrical switch 518 and closes this switch. Thus, when the ball 900 passes an electronic valve 300-2 (see FIG. 11), the ball detection switch 510 closes the electrical switch 518, which sends an electrical signal to processor 504. This signal is interpreted by processor 504 as the passing of one ball 900 and in this way, the processor counts how many balls are passing through the electronic valve hosting the processor.

When the counted value equals a preassigned value (which is loaded by the operator of the electronic valve into the processor prior to deploying the electronic valve in the well), the processor instructs the associated dump valve 360 to open and allow the casing fluid 400 to activate sleeve 320 and piston 350, as previously discussed. In other words, the processor counts the number of balls passing its host electronic valve, and when the predetermined counter reaches zero, the controller instructs the dump valve to open. In this way, each electronic valve is configured to open its corresponding dump valve 360 as soon as the expected number of balls 900 have passed through the electronic valve.

Note that this mechanism has the advantage of opening the dump valve of a next electronic valve in the cluster of electronic valves just a short time before a ball 900 get seated into its seat 340 of a current electronic valve in the cluster of electronic valves. This is desired because as soon as the flow of well fluid in the current electronic valve is stopped by the ball 900, the next electronic valve needs to open its ports to the formation so that the flow of well fluid continues without interruption. In this regard, the surface pump 710 operates in a continuous manner and it is desired that this operation is not changed. Thus, the fracturing of the next zone is automatically started after the passing of an expected number of balls. The process advances automatically from one electronic valve to another until the entire cluster of electronic valves is opened.

Figure 12:
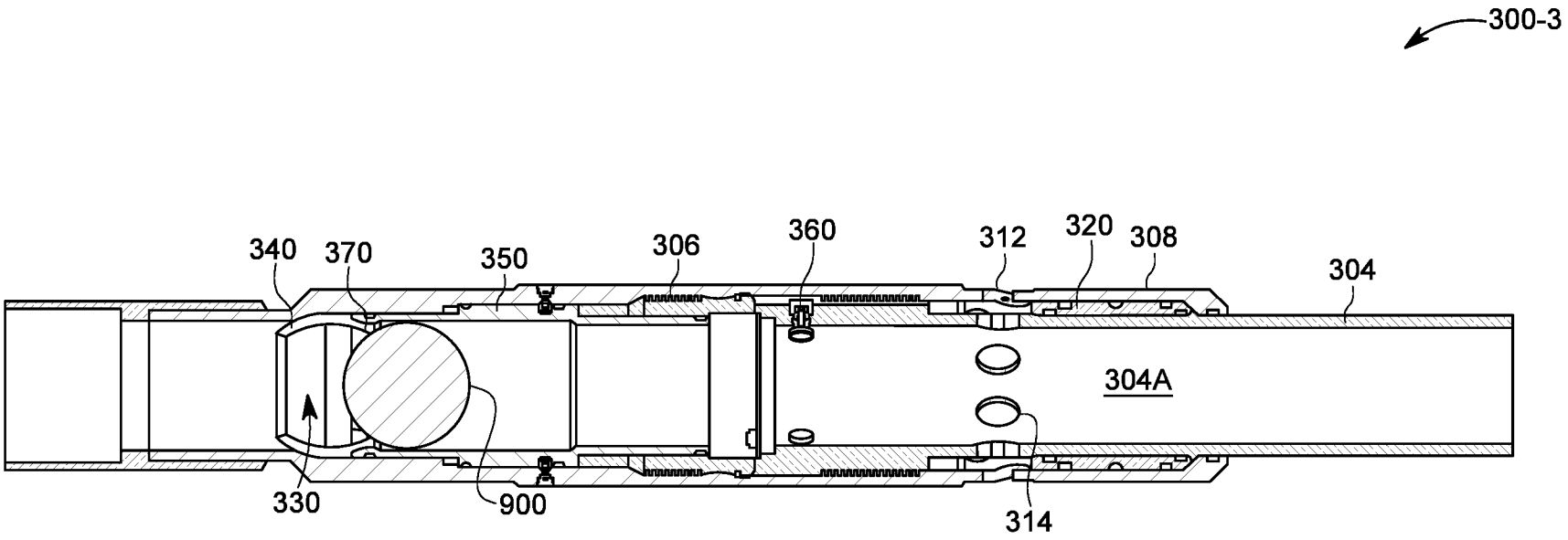
FIG. 12 illustrates a ball interacting with the electronic valve during a flowback operation.

When the fluid flow is reversed in the casing, i.e., from the toe to the head of the casing, the ball seated at the first seat 340 of an electronic valve **300-*i* in the cluster moves to the second seat 370 of a previous electronic valve 300-(*i*−1), where the index i starts with value 1 for the most distal electronic valve (300-1 in FIG. 7) and increases by one for a next electronic valve. This process is illustrated in FIG. 12, in which ball 900 is shown being now seated in the second seat 370 of electronic valve 300-3, which is upstream of the electronic valve 300-2 shown in FIGS. 10 and 11. Because the second seat 370 has the tabs 344 (see, for example, FIGS. 4A and 4B), the fluid 400 passes the ball 900 and the second seat 370 in the upstream direction, i.e., the ball 900 and its second seat 370 do not seal the bore 304**A. This is desired and advantageous because no ball seating in the second seat of any electronic valve would block the back flow of the fluid in the casing, meaning that the oil and/or gas from the fractured formations can freely move upstream in the casing.

Figure 13:
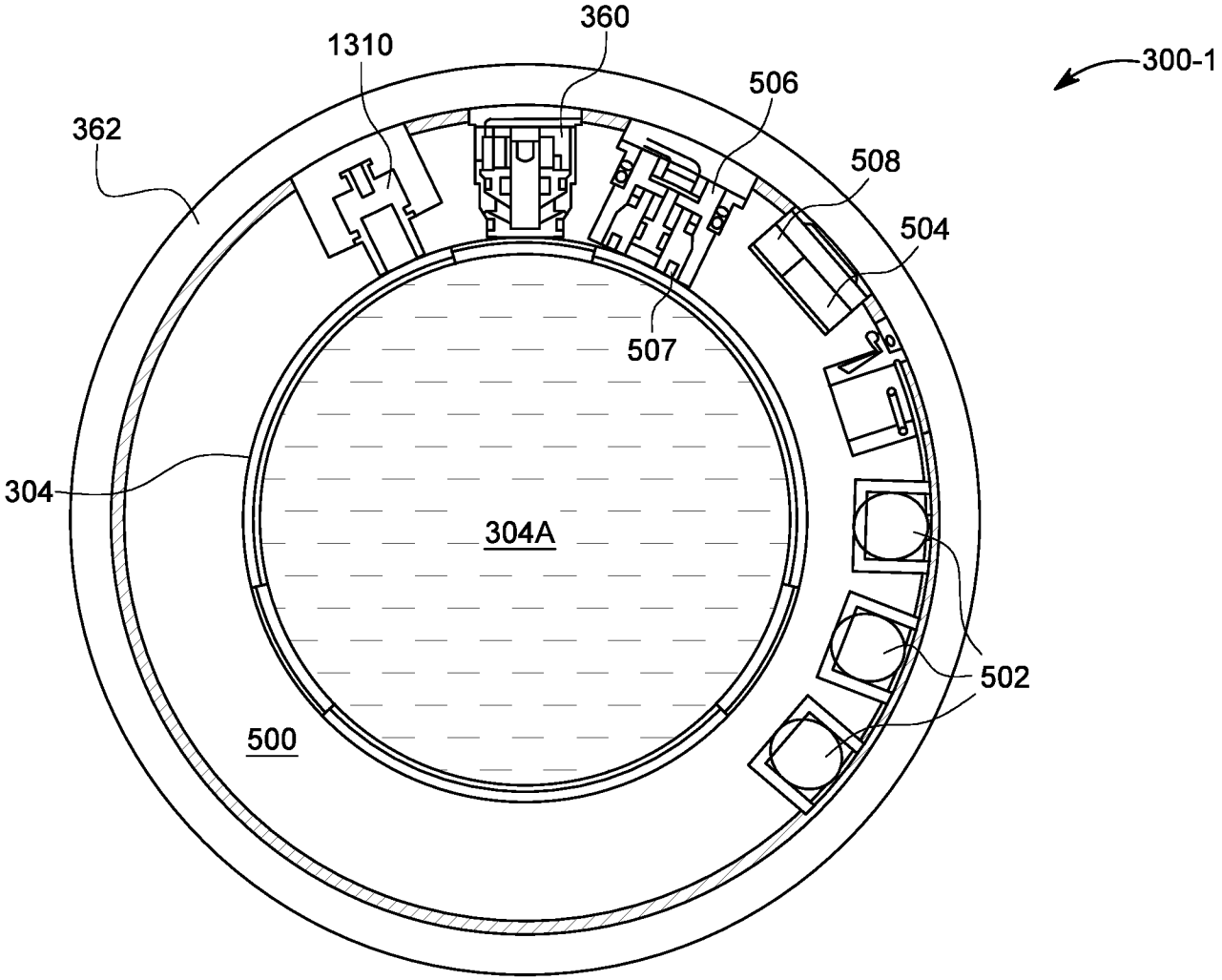
FIG. 13 illustrates a pressure transducer located in the electronic valve and used to arm another electronic valve.

The embodiments discussed above have used a ball detection switch 510 (see FIG. 5) for counting the passing of a ball through each electronic valve. In one embodiment, it is possible to replace the ball detection switch 510 with a pressure transducer 1310, which is placed in the empty pocket 500, in which the other electronic components are placed, as illustrated in FIG. 13. For this embodiment, the opening of the dump valve 360 is achieved as now discussed.

Figure 14A:
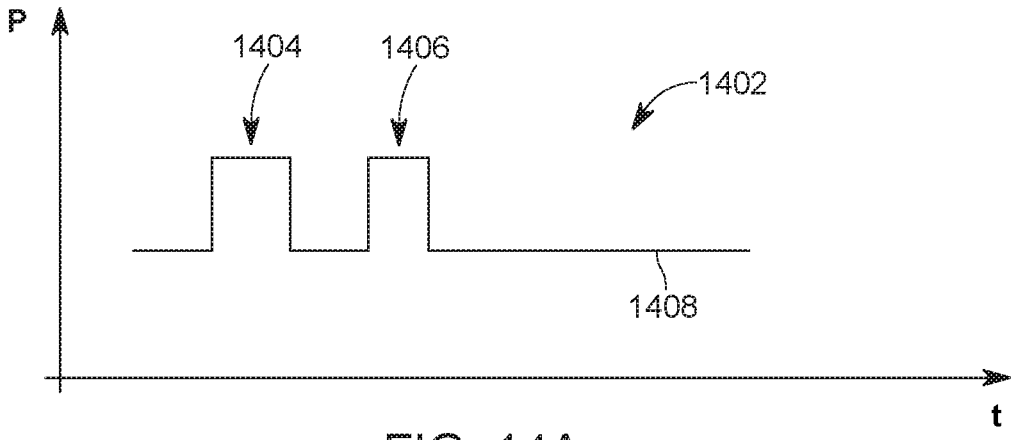
FIGS. 14A and 14B illustrate pressure patterns that may be used to signal the pressure transducer.
Figure 14B:
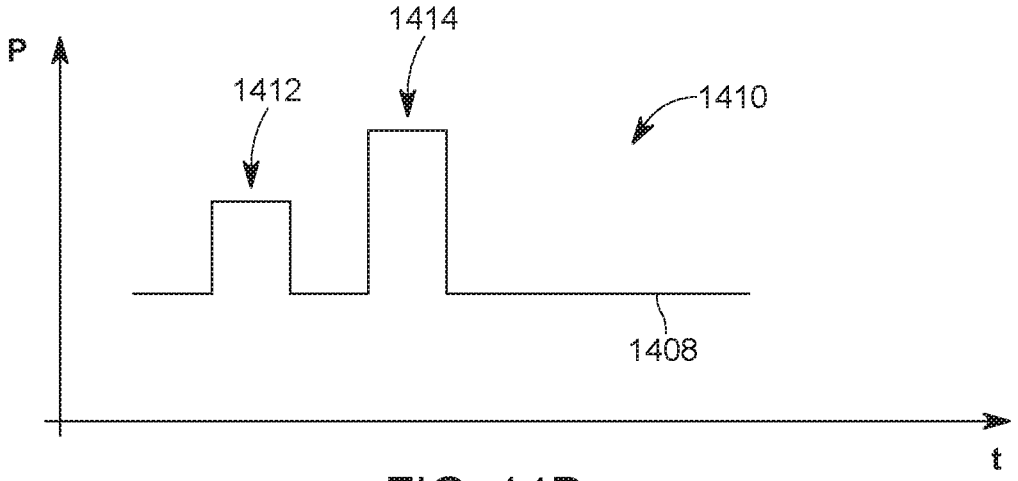

The well is fractured with water and sand. The pumping rate of the water and sand should be above a minimum rate, to keep the sand from settling inside the casing and blocking the bore 304A of the electronic valve 300. This minimum rate of the pump 710 prevents the well from "sanding out" and plugging the well. The flow rate causes a fluid pressure increase that is sensed by all of the electronic valves having the pressure transducer 1310. Thus, it is possible to implement a communication protocol with each electronic valve by assigning a unique pressure change pattern to each pressure transducer. In this way, by increasing and decreasing the flow rate and then returning it to the minimal rate, following a certain pattern, can be recognized by the controller 504, based on the pressure readings from the pressure transducer 1310. For example, FIG. 14A shows a first pattern 1402 and FIG. 14B shows a second pattern 1410. The first pattern 1402 includes two highs 1404 and 1406 having the same amplitude followed by a reference pressure 1408 while the second pattern 1410 includes a first high 1412 followed by a second high 1414 that has an amplitude larger than the first high, and then followed by the reference pressure 1408. Each pattern (many other patterns can be defined so that each pressure transducer has a unique pressure pattern) is unique and thus, can be identified only by one pressure transducer and its associated processor. When that happens, the processor associated with that pressure transducer arms the dump valve. When the pressure transducer determines a sudden high pressure in the casing, the current electronic valve is opened and there is fluid communication between the formation and the interior of the casing, i.e., the fracturing operation is on.

Near the end of the time allocated to fracture the current zone, a ball is dropped. The ball lands on the first seat 340 of electronic valve 300-1, as previously discussed with regard to FIG. 9 and seals the first zone. A pressure spike occurs in the casing behind the first ball 900. This sudden increase in pressure is detected by the pressure transducer of the next electronic valve 300-2, and its processor uses this signal to open the dump valve, thus opening the ports in the second electronic valve, and making the first and second seats. The fluid flow is now re-directed through the second electronic valve, which is now open. This new zone is now fractured. The flow rate downstream the ball is isolated and thus its velocity goes to zero. The sand will drop out, but the amount of sand is limited by only what is in the fluid at that instant.

As in the previous method, the fracturing can be continuously performed, without having to stop and start the pump 710 as the seating of each ball for a given electronic valve 300-*i* automatically opens the next electronic valve 300-(*i*–1) in the cluster of electronic valves. This process is repeated until all the electronic valves are opened and their corresponding zones are fractured. Each of the balls is trapped between the electronic valves due to the making of the first and second seats. When the fluid flow is reversed, the balls can roll against the corresponding seats from the next electronic valves, but their tabs are designed to allow fluid flow around the balls, as discussed above with regard to FIG. 12. In this embodiment, the pressure transducers are used for two different functions: 1) the unique pressure pattern is used to arm each of the electronic valves, and 2) the sudden pressure increase due to ball seating, signals the electronics to open the ports (only for the armed electronic valve).

In one embodiment, it is possible to configure the electronics of the electronic valve to learn. For example, it is possible to hold the initial flow rate at the minimal value for a few minutes, then the electronics uses this pressure value as the "low value" or "reference value." Then, the pressure value is ramped up to a higher value, which is hold for a few minutes, and this value is used as the "high value."

The non-stop fracturing processed discussed above reduces the chances of "sanding out," and the variable rate pumping produces better fracturing. If the unique pattern 1402 is not recognized before the ball takes its seat, the pressure will increase because the well is plugged. In this case, it is possible to deliver with the pump 710 the unique pattern without any flow to arm the electronic valve and then apply a sudden high pressure to command the armed electronic valve to open.

In one application, the ball counter could be replaced by an acoustic device, a RFID detector, a magnetic sensor, or other sensing device. In another application, the hydrostatic pressure may be used to push open the sleeve 320. In yet another application, it is possible to implement the dump valve to release a catch. As the fluid flow or ball pushes against the catch, it would open the sleeve. In still another application, the deforming seat device could be replaced with a flapper valve.

Figure 15:
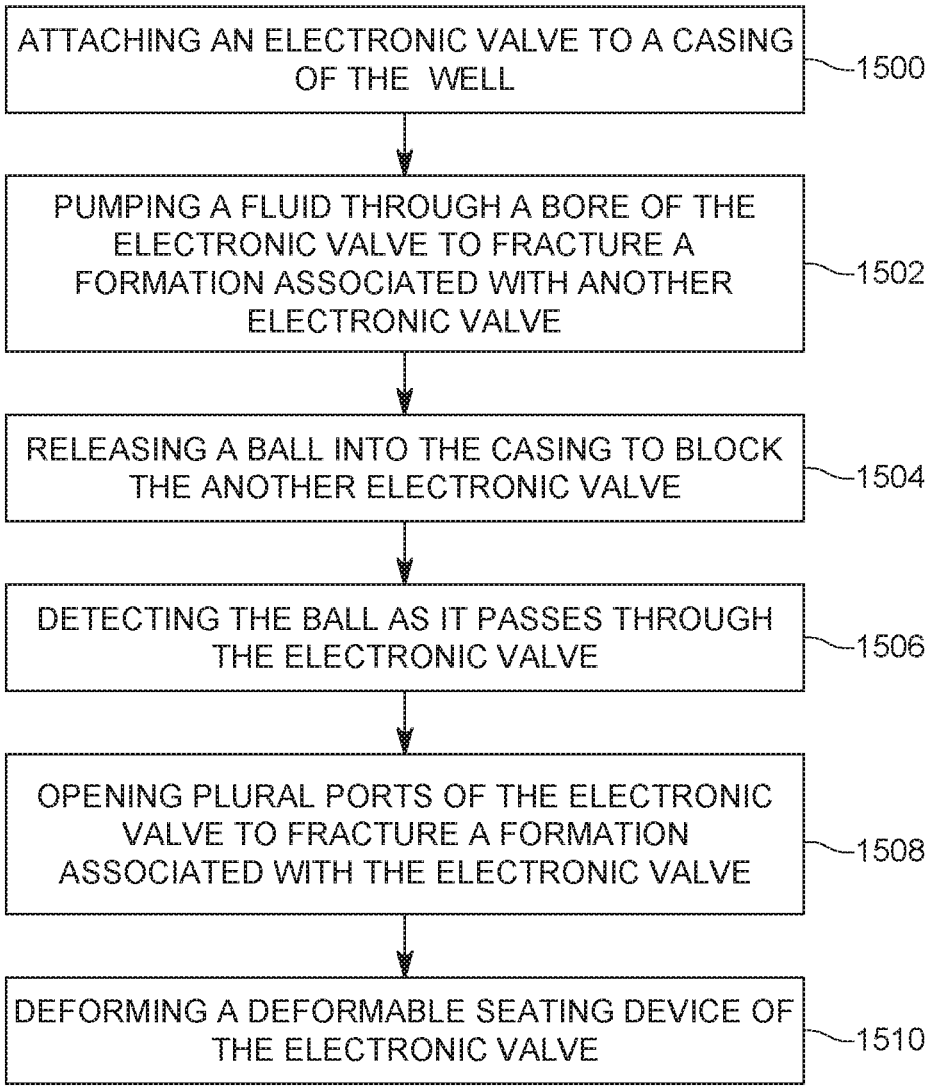
FIG. 15 is a flowchart of a method for fracturing a well with a cluster of electronic valves.

A method for fracturing a well with an electronic valves 300 is now discussed with regard to FIG. 15. The method includes a step 1500 of attaching the electronic valve 300 to a casing 702 of the well 704, a step 1502 of pumping a fluid through a bore 304A of the electronic valve 300 to fracture a formation associated with another electronic valve, a step 1504 of releasing a ball 900 into the casing to block the another electronic valve, a step 1506 of detecting the ball 900 as it passes through the electronic valve 300, a step 1508 of opening plural ports 314 of the electronic valve 300 to fracture a formation associated with the electronic valve, and a step 1510 of deforming (or changing a geometry if the seating device is not deformed per se) a deformable seating device 330 of the electronic valve 300.

The method may further include a step of actuating a dump valve to (1) allow the fluid to enter a first passage of the electronic valve to push a sleeve to open the plural ports, and (2) allow the fluid to enter a second passage of the electronic valve to push a piston to deform the deformable seating device. In one application, the method may also include a step of counting a number of balls that pass through the electronic valve with a ball detection switch, or a step of applying a pressure pattern to the fluid in the casing, and a step of detecting with a pressure transducer of the electronic valve the pressure pattern to actuate the valve.

At least one of the valves discussed above, because of its deforming seat, does not need to have a plug lowered later. After all of the fracturing is complete, normally the plugs will be drilled out. The deforming seat of this valve has much less material to mill out than a normal plug.

The disclosed embodiments provide an electronic valve that is used for fracturing. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An electronic valve system to be placed in line with a casing in a well, the electronic valve system comprising:

a housing having plural ports;

a sleeve configured to block the plural ports;

a valve configured to initiate unblocking of the plural ports to allow fluid communication between the bore of the housing and an outside of the housing;

a deformable seat device having a body placed inside of the bore of the housing; and a hollow piston located in the bore of the housing, wherein the deformable seat device is configured to have a given diameter D3 for at least one of first and second ends of the body when the plural ports are blocked, and a smaller diameter when the plural ports are unblocked, and wherein the valve is configured to fluidly communicate, (1) along a first direction, with the sleeve, to slide the sleeve to unblock the plural ports, and, (2) along a second direction, opposite to the first direction, with the hollow piston, to slide the hollow piston to deform the deformable seat device.

2. The electronic valve system of claim 1, wherein the hollow piston is configured to push the deformable seat device upstream and to bend a first end of the deformable seat device to form a first seating and to bend a second end of the deformable seat device to form a second seating.

3. The electronic valve system of claim 2, wherein the housing includes an inner mandrel connected to an upper body, and a bore of the upper body has a varying diameter.

4. The electronic valve system of claim 3, wherein the deformable seat device bends the first end when advancing along the varying diameter of the bore of the upper body, to form the first seating.

5. The electronic valve system of claim 2, wherein the valve is configured to establish fluid communication between a fluid inside the bore of the housing and the hollow piston, so that the hollow piston is actuated by the pressure of the fluid.

6. The electronic valve system of claim 5, wherein the valve is configured to establish fluid communication between (1) the fluid inside the bore of the housing and (2) the sleeve, which is located between (a) the inner mandrel, and (b) an external cover of the inner mandrel, so that the plural ports are unblocked by translating the sleeve.

7. The electronic valve system of claim 1, further comprising:

a processor formed in a pocket of the housing, where the processor is connected to the valve and is configured to actuate the valve.

8. The electronic valve system of claim 7, further comprising:

a ball detecting device formed in the pocket of the housing, the ball detecting device being electrically connected to the processor for providing information about the presence of a ball that passes through the bore of the housing.

9. The electronic valve system of claim 8, wherein the ball detecting device is a switch that physically interacts with a passing ball.

10. The electronic valve system of claim 8, further comprising:

a power supply located in the pocket and configured to supply power to the processor and the ball detecting device; and a start switch assembly that electrically connects the power supply to the processor, wherein the start switch assembly is configured to be actuated by a pressure inside the bore of the housing.

11. The electronic valve system of claim 1, wherein the valve is formed within a wall of the housing.

12. The electronic valve system of claim 1, wherein the housing includes an inner mandrel and an external cover that is located over the inner mandrel to form a chamber, the sleeve is located in the chamber and blocks fluid communication between the plural ports formed in the inner mandrel and plural ports formed in the external cover.

13. The electronic valve system of claim 12, wherein there is a first passage extending between the inner mandrel and the external cover, fluidly linking the valve and the sleeve, and there is a second passage, extending between the inner mandrel and the external cover, fluidly linking the valve and the hollow piston that bends the deformable seat device.

14. The electronic valve system of claim 13, wherein the piston has tabs at one end that allow fluid to pass through the piston when a ball is seated on the tabs.

15. A well fracturing system for fracturing a well, the system comprising:

a casing having plural tubular modules; and one or more electronic valve systems integrated with the plural tubular modules, wherein an electronic valve system of the one or more electronic valve systems has, a sleeve configured to block plural ports, and a deformable seat device having first and second ends and configured to have a diameter of each one of the first and second ends decreased when actuated by a piston.

16. The system of claim 15, wherein the electronic valve system comprises:

a housing having the plural ports that are blocked;

a valve formed within a wall of the housing and configured to initiate unblocking of the plural ports to allow fluid communication between the bore of the housing and an outside of the housing; and the deformable seat device has a body placed inside of the bore of the housing.

17. The system of claim 16, wherein a hollow piston is located in the bore of the housing, and the hollow piston is configured to push the deformable seat device upstream and to bend the first end of the body of the deformable seat device to form a corresponding first seating and to bend the second end of the body of the deformable seat device to form a corresponding second seating.

18. The system of claim 17, wherein the housing includes an inner mandrel connected to an upper body, and a bore of the upper body has a varying diameter.

19. The system of claim 18, wherein the deformable seat device changes a geometry of the first end when advancing along the varying diameter of the bore of the upper body, to form the corresponding first seating.

20. The system of claim 16, wherein the valve is configured to establish fluid communication between a fluid inside the bore of the housing and a hollow piston and the sleeve, so that the hollow piston is actuated by the pressure of the fluid along a first direction and the sleeve is actuated along a second direction, opposite to the first direction.

21. The system of claim 20, wherein the valve is configured to establish fluid communication between the fluid inside the bore of the housing and the sleeve, which is located between the inner mandrel, and an external cover of the inner mandrel, so that the ports are unblocked by translating the sleeve.

22. A method for fracturing a well with an electronic valve system, the method comprising:

attaching the electronic valve system to a casing of the well;

pumping a fluid through a bore of the electronic valve system to fracture a formation associated with another electronic valve system;

releasing a ball into the casing to block the another electronic valve system;

detecting the ball as the ball passes through the electronic valve system;

opening plural ports of the electronic valve system to fracture a formation associated with the electronic valve system; and changing a geometry of a deformable seat device of the electronic valve system, wherein the opening of the plural ports is achieved with a sleeve actuated along a first direction by the fluid in the bore of the electronic valve system, wherein the changing of the geometry of the deformable seat device is achieved with a hollow piston actuated along a second direction, opposite to the first direction, by the fluid in the bore of the electronic valve system, wherein a valve of the electronic valve system establishes a fluid communication between the bore of the electronic valve system and (1) the sleeve and (2) the hollow piston, and wherein the sleeve and the hollow piston are part of the electronic valve system.

23. The method of claim 22, further comprising:

actuating a dump valve to (1) allow the fluid to enter a first passage of the electronic valve system to push the sleeve to open the plural ports, and (2) allow the fluid to enter a second passage of the electronic valve system to push the hollow piston to deform the deformable seat device.

24. The method of claim 22, further comprising:

counting a number of balls that pass through the electronic valve system with a ball detection switch.

25. The method of claim 22, further comprising:

applying a pressure pattern to the fluid in the casing; and detecting with a pressure transducer of the electronic valve system the pressure pattern to actuate the valve.

* * * * *